United States Patent [19]

Lind

[11] Patent Number: 4,659,342

[45] Date of Patent: Apr. 21, 1987

[54] METHOD OF CONTROLLING OPERATION OF AN ELECTROSTATIC PRECIPITATOR

[75] Inventor: Leif Lind, Copenhagen, Denmark

[73] Assignee: F.L. Smidth & Co., Cresskill, N.J.

[21] Appl. No.: 605,180

[22] Filed: Apr. 30, 1984

Related U.S. Application Data

[63] Continuation-in-part of Ser. No. 331,016, Dec. 15, 1981, abandoned.

[30] Foreign Application Priority Data

Dec. 17, 1980 [GB] United Kingdom ..... 8040463

[51] Int. Cl.[4] ..... B03C 3/68

[52] U.S. Cl. ..... 55/2; 55/105; 323/903

[58] Field of Search ..... 55/2, 105, 139; 323/903

[56] References Cited

U.S. PATENT DOCUMENTS

| | | | |
|---|---|---|---|
| 3,166,705 | 1/1965 | Brandt | 55/105 X |
| 3,443,358 | 5/1969 | Drenning | 55/2 |
| 3,622,839 | 11/1971 | Abrams et al. . | |
| 3,745,749 | 7/1973 | Gelfand | 323/903 X |
| 3,959,715 | 5/1976 | Canning . | |
| 3,981,695 | 9/1976 | Fuchs . | |
| 3,984,215 | 10/1976 | Zucker | 55/2 |
| 4,052,177 | 10/1977 | Kide . | |
| 4,133,649 | 1/1979 | Milde . | |
| 4,152,124 | 5/1979 | Davis . | |
| 4,267,502 | 5/1981 | Reese et al. . | |
| 4,311,491 | 1/1982 | Bibbo et al. . | |
| 4,354,860 | 10/1982 | Herklotz et al. . | |
| 4,413,225 | 11/1983 | Donig et al. | 55/105 X |
| 4,445,911 | 5/1984 | Lind | 55/2 |

FOREIGN PATENT DOCUMENTS

| | | |
|---|---|---|
| 680837 | 2/1964 | Canada . |
| 1080979 | 5/1960 | Fed. Rep. of Germany . |
| 2208724 | 6/1974 | France . |
| 981147 | 1/1965 | United Kingdom . |
| 1017351 | 1/1965 | United Kingdom . |
| 1154972 | 6/1969 | United Kingdom . |
| 1544105 | 4/1979 | United Kingdom . |

OTHER PUBLICATIONS

H. H. Petersen and P. Lausen, "Precipitator Energization Utilizing an Energy Conserving Pulse Generator", presented at *The Second Symposium on the Transfer and Utilization of Particulate Control Technology,* Denver, Colo. (Sep. 1980) and published in EPA-600-9/-80-0396.

S. Olesen and P. Lausen, "An Energy Conserving Pulse System for Electrostatic Precipitators", presented at the Conference Coal Technology, Europe '81, Cologne, West Germany, Jun., 1981.

*Primary Examiner*—Kathleen J. Prunner

*Attorney, Agent, or Firm*—Pennie & Edmonds

[57] ABSTRACT

A method is disclosed for controlling the operating parameters of an electrostatic precipitator of the type having electrodes energized by pulses superimposed upon a DC-voltage. According to the method, the pulse height (i.e., amplitude) is continuously increased at a predetermined rate and spark-overs are thereby detected as reductions in the precipitator-voltage below a selectable set value and are sorted in different types according to the time of their occurrence and duration. Thereafter, the operating parameters of the precipitator are altered in dependence upon the characteristics of the actual spark-over.

18 Claims, 5 Drawing Figures

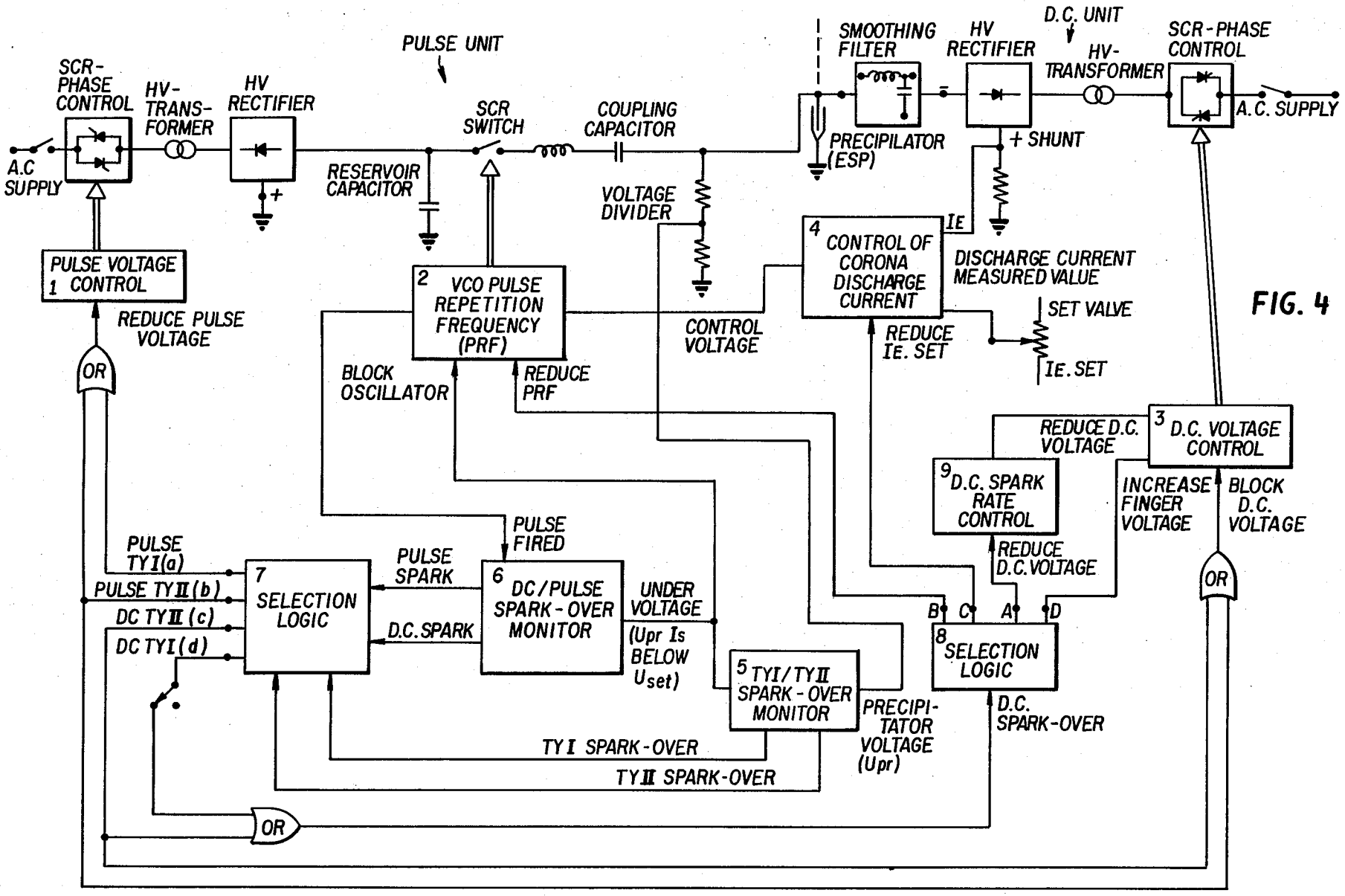
FIG. 4
A.C. SUPPLY
SCR-PHASE CONTROL
D.C. UNIT
HV-TRANSFORMER
HV RECTIFIER
+ SHUNT
SMOOTHING FILTER
PRECIPILATOR (ESP)
3 D.C. VOLTAGE CONTROL
BLOCK D.C. VOLTAGE
OR
INCREASE FINGER VOLTAGE
REDUCE D.C. VOLTAGE
DISCHARGE CURRENT MEASURED VALUE
SET VALVE
IE. SET
IE
4 CONTROL OF CORONA DISCHARGE CURRENT
REDUCE IE. SET
9 D.C. SPARK RATE CONTROL
REDUCE D.C. VOLTAGE
8 SELECTION LOGIC
D.C. SPARK-OVER
PRECIPI-TATOR VOLTAGE (Upr)
5 TYI/TYII SPARK-OVER MONITOR
CONTROL VOLTAGE
VOLTAGE DIVIDER
COUPLING CAPACITOR
UNDER VOLTAGE (Upr Is BELOW Uset)
TY I SPARK-OVER
TY II SPARK-OVER
PULSE UNIT
SCR SWITCH
2 VCO PULSE REPETITION FREQUENCY (PRF)
REDUCE PRF
PULSE FIRED
6 DC/PULSE SPARK-OVER MONITOR
RESERVOIR CAPACITOR
BLOCK OSCILLATOR
PULSE SPARK
D.C. SPARK
7 SELECTION LOGIC
HV RECTIFIER
HV-TRANS-FORMER
SCR-PHASE CONTROL
A.C SUPPLY
PULSE VOLTAGE 1 CONTROL
REDUCE PULSE VOLTAGE
PULSE TYI(a)
PULSE TYII(b)
DC TYII(c)
DC TYI(d)

METHOD OF CONTROLLING OPERATION OF AN ELECTROSTATIC PRECIPITATOR

This is a continuation-in-part of application Ser. No. 331,016 filed Dec. 15, 1981, now abandoned.

TECHNICAL FIELD

The invention relates to a method of controlling the operating parameters of an electrostatic precipitator which is energized by voltage pulses superimposed on a DC-voltage.

BACKGROUND ART

It is a documented fact that the performance of conventional two-electrode precipitators can be improved by pulse energization where high voltage pulses of suitable duration and repetition rate are superimposed on an operating DC-voltage.

For practical application, automatic control of any precipitator energization system is of major importance in order to secure optimum performance under changing operating conditions and to eliminate the need for supervision of the setting of the electrical parameters.

With conventional DC energization, commonly used control systems regulate precipitator voltage and current, and in general terms, the strategy is aimed at giving maximum voltage and current within the limits set by spark-over conditions. The possibilities of different strategies are extremely limited, since the precipitator voltage is the only parameter which can be regulated independently.

In contradistinction, pulse energization allows independent control of the following parameters:

1. DC Voltage level
2. Pulse voltage level
3. Pulse repetition frequency
4. Pulse width The possibility of combining the setting of several parameters enables development of highly efficient control strategies, if the phenomena taking place in the precipitator are measured and interpreted correctly.

I have invented a method of controlling these parameters to obtain an optimum operation of a pulse energized precipitator. More particularly, I have invented a method of controlling the pulse height in a manner to maintain the sum of the DC-voltage and the pulse height as high as possible, that is as high as it can be without causing an excessive number of spark-overs, when the DC-voltage is set or regulated to an optimal value.

DISCLOSURE OF THE INVENTION

The present invention relates to a method of controlling the operating parameters of an electrostatic precipitator having electrodes energized by pulses superimposed upon a DC-voltage which comprises, continuously increasing the height of the pulses according to a predetermined rate, determining reductions in the precipitator-voltage below a preselected value in order to determine spark-over thereof, categorizing the spark-overs according to the time of their occurrence and duration, and adjusting the operating parameters of the electrostatic precipitator in dependence upon the characteristics of the actual spark-over.

Thus, according to the invention, such control can be achieved by allowing the height of the pulses to increase linearly with a preselected slope; detecting spark-overs as drops in the precipitator-voltage below a preselected set value; sorting the voltage drops in different types according to the time of their occurrence and the duration of the voltage drop; and modifying the operating parameters of the precipitator in dependence upon the type of spark-over.

When a spark-over occurs, the voltage pulses may be stopped for the period of time during which the precipitator voltage is below the set value plus a preselected period thereafter.

The spark-overs can be sorted into the following four types:

(a) spark-over occuring during a pulse and causing a voltage drop of short duration;

(b) spark-over occurring during a pulse and causing a voltage drop of long duration;

(c) spark-over occurring between pulses and causing a voltage drop of long duration;

(d) spark-over occurring between pulses and causing a voltage drop of short duration.

As a type (a) spark-over may indicate that the pulse voltage is too high, this type of pulse can be arranged to cause the pulse height to be reduced by a certain amount.

A type (b) spark-over can be arranged to cause the pulse height to be reduced and further causes the DC-HT (HT, i.e. high tension) supply to be turned off for a certain period.

A type (c) spark-over may be arranged to cause one or more of the following precautions to be taken:

Reduction of the DC-level by a certain predetermined amount and subsequently raising of it again;

Reduction of the pulse repetition frequency by a certain amount and subsequently raising of it again;

Reduction of the set value for the precipitator discharge current by a certain amount and subsequently raising of it again;

Increase of the plateau voltage where the DC-voltage is controlled by using a periodically occuring plateau of increased voltage.

A type (d) spark-over may cause a similar reaction as a type (c) spark-over, or no reaction may be caused except for the pulse voltage blocking which is caused by any spark-over.

BRIEF DESCRIPTION OF THE DRAWINGS

Preferred embodiments of the invention will now be described with reference to the accompanying drawings wherein:

FIG. 4 illustrates in block diagram form a circuit for controlling the operating parameters of an electrostatic precipitator having electrodes energized by voltage pulses superimposed on a DC-voltage in accordance with the present invention.

BEST MODE FOR CARRYING OUT THE INVENTION

Figure 1:
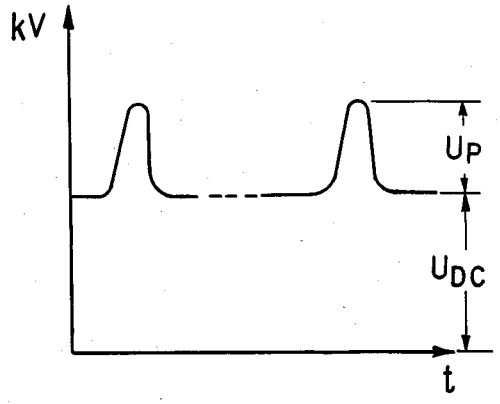
FIG. 1 illustrates schematically, pulses superimposed on a DC-voltage for energizing an electrostatic precipitator.

Referring to FIG. 1, there is shown schematically voltage pulses of height UP superimposed on a DC-voltage $U_{DC}$ for energizing an electrostatic precipitator. The Fig. shows the voltage on the discharge electrode as a function of time. This voltage will usually be negative, so what is depicted here is the numeric (or absolute) value of the voltage. In the following explanation voltage levels and increases or decreases accordingly refer to the numerical value of the voltage.

In order to fully benefit from the pulse technique, it is important that the DC-level is maintained as high as possible, that is, slightly below the corona extinction voltage, or at a voltage creating a certain corona current depending on actual application.

For applications with high resistivity dust, optimum performance is obtained with the DC-voltage maintained slightly below the corona extinction voltage. The object is to extinguish completely the corona discharge after each pulse. Combined with suitably long intervals between pulses, this allows the DC field to remove the ion space charge from the interelectrode spacing, before the next pulse is applied, and thus permits high pulse peak voltages without sparking. Furthermore, it allows full control of the corona discharge current by means of pulse height and repetition frequency.

In applications with lower resistivity dust, a certain amount of corona discharge at the DC-voltage level is advantageous to secure a continuous current flow through the precipitated dust.

When the DC-voltage is controlled to its optimum, the optimal pulse height is established and controlled on the basis of the demand for the highest possible sum of the DC plus pulse voltage by means of the procedure described hereinbelow.

At start-up, the voltage pulses are inactivated until the DC-voltage level has reached the desired value. Thereafter, the pulse height is increased to a start value (selectable, for example, between 33 and 67% of the maximum pulse height).

From this value the pulse amplitude increases continuously until a spark-over occurs during a pulse. The amplitude of the pulses increases with an adjusted rate of rise. After a spark-over the pulse amplitude is reduced by a certain amount (selectable, for example, between 1 and 5% of the rated value), and thereafter increased linearly with the same rate of rise (corresponding, for example, to a variation from 0 to rated value within a selectable period between 1 and 10 min). The pulse height can be limited to a maximum value lower than the rated value (selectable, for example, between 50 and 100% of the rated value).

When the DC plus pulse voltage is brought to the optimum value, the corona discharge current is controlled to maintain a set value (selectable for example, between 20 and 100% of the rated generator current) by a closed loop control controlling the repetition frequency.

A lower and upper limit can be set in the total range of the pulse repetition frequency.

In another embodiment, the corona discharge current is measured with selectable time intervals, and the pulse repetition frequency is increased or decreased by a selectable value, depending upon whether the measured value is lower or higher than a set value.

At start-up, the pulse repetition frequency control is inactivated until the DC-voltage level has reached the desired value as described. The above mentioned setting of a lower limit is used as an initial value in the embodiment, where the corona discharge current is controlled.

As outlined above, the controlling of the operating parameters of the precipitator is to a great extent based upon the detection of spark-overs, as reductions in the precipitator voltage below a set value, controlling the different parameters of the precipitator, depending upon the time for and the duration of such voltage reductions.

Figure 2:
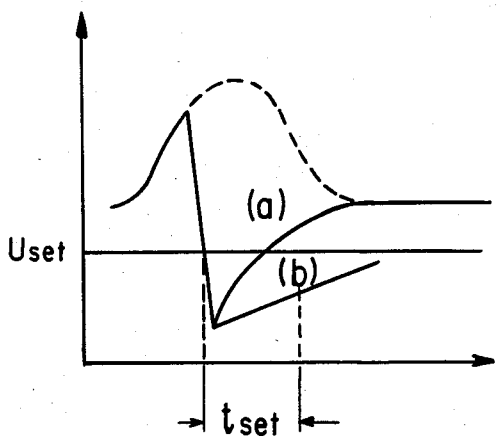
FIG. 2 illustrates schematically, a voltage/time diagram of a classification of spark-overs during a pulse.

FIG. 2 schematically shows a spark-over during one of a series of linearly increasing pulses. The pulse period is defined in the control device as a time interval equal to the pulse width after the ignition of the switch element initiating the application of a pulse. The control device determines the occurrence of a spark-over if the precipitator voltage falls below a certain level $U_{set}$ (selectable for example, between 0–50 kV). If the voltage within a certain period [selectable for example, between 20 μs (i.e., microseconds) and 20 ms (i.e., milliseconds)-]returns to a value above the set level, the spark-over is classified as type I. If not, it is classified as type II.

In FIG. 2, the voltage is shown as falling below the level $U_{set}$. The curve (a) shows a type I spark-over, as the voltage increases over the set level $U_{set}$ before the lapse of the set time, $t_{set}$. In the same way the curve (b) is seen to represent a type II spark-over, as $U_{set}$ is not reached within the time period $t_{set}$.

Figure 3:
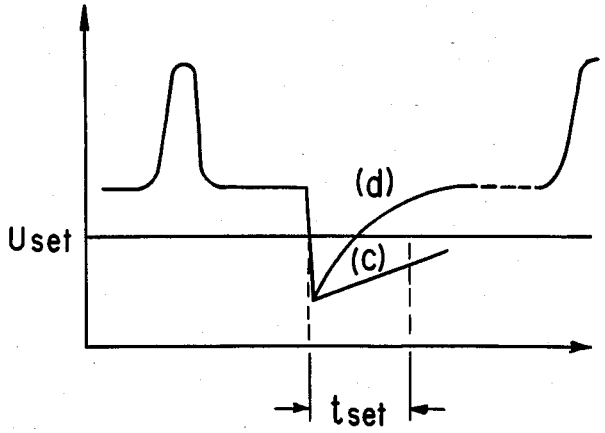
FIG. 3 illustrates schematically, a voltage/time diagram of a classification of spark-overs between pulses.

Correspondingly, FIG. 3 shows a spark-over between pulses, the curve (d) represents a type I spark-over, and curve (c) shows a type II spark-over.

The spark-overs are sorted in four categories and at each spark-over different precautions are taken with respect to its category.

At all spark-overs, the voltage pulses are turned off until the DC voltage again rises above the voltage set value and for a selectable time thereafter. For a type I spark-over during a pulse, the pulse height must be reduced. This is done by a certain amount (selectable for example, between 1 and 5% of the rated pulse height).

A type I spark-over between pulses can also be reacted to as to a corresponding type II as will be described, or the above mentioned turning off of the pulse voltage, taking place after all spark-overs, can be the only reaction.

A type II spark-over causes the DC-HT supply to be turned off for a certain period (selectable for example, between 10 and 500 ms). This is to extinguish the current and thus eliminate the conduction path created by the spark-over. If it occurs during a pulse it further causes the reduction of pulse height described above.

If it occurs between pulses, the turning off of the DC-HT supply may be the only reaction, or one or more of the following precautions may be taken, depending on the main reason for the spark-over in the actual situation, which is the combined effect of the electrical field from the DC-voltage and the corona discharge current.

a. The DC voltage level is reduced by a certain amount (selectable, for example, between 0 and 6 Kv).

b. The pulse repetition frequency is reduced by a certain amount (selectable, for example, between 5 and 50% of the value previous to the spark-over).

c. The set value of the discharge current is reduced by a certain amount (selectable, for example, between 5 and 25% of the value previous to the spark-over). Hereafter, the set value is either maintained or raised linearly with a a given slope (corresponding, for example, to a variation between 0 and 100% of the maximum generator current within a period selectable between 1 and 10 min).

d. If the DC-voltage is controlled using a periodically occuring finger of a preset increased voltage, this finger-voltage is increased.

In FIG. 4 the blocks 1–4 represent the controls necessary to control the DC-voltage, the pulse voltage and the pulse repetition frequency for a pulse energized electrostatic precipitator. The electrostatic precipitator ESP is supplied with high voltage DC from a DC-unit. The high voltage is obtained through transforming and rectifying an AC voltage obtained from an AC-main supply. The height of the DC voltage on the filter can further be controlled through the use of SCR (silicon controlled rectifier) control which controls the energy led from the AC supply to the high voltage transformer.

In the same way a DC high voltage on a reservoir capacitor in a pulse unit can be regulated and the height of this voltage determines the height of the pulses which are superimposed on the high DC-voltage on the filter whenever a SCR-switch is closed. The trigger pulses for this SCR are obtained from a voltage controlled oscillator shown as block 2.

Block 1 consists of a firing unit, a voltage controller and a reference unit. The reference unit gives a reference voltage which is applied to one of the inputs of the voltage controller and basically determines the rate of rise of the pulse voltage as well as the voltage reduction when an input signal indicates that the pulse voltage should be reduced.

Block 1 controls the pulse height through controlling the energy led to the reservoir capacitor of the pulse unit. This control is obtained through an SCR switch controlling the AC from an AC supply to a high voltage (HV) transformer which through a HV rectifier feeds the reservoir capacitor of the pulse unit. The pulse voltage is continuously increased at a settable rate defined by a reference unit comprised in the block 1. When receiving an input signal the phase voltage control (block 1) lowers the pulse voltage by a value also set in the reference circuit.

In the same way the DC-voltage controller in block 3 controls the DC-voltage of the precipitator to be increased at a selectable rate and to be momentarily lowered by a settable value when receiving an input signal. In a conventional precipitator such a voltage lowering input signal is given off to the controller when a spark-over occurs.

Block 3 also consists of a firing unit, a voltage controller and a reference unit. The reference unit gives a reference voltage which is applied to one of the inputs of the voltage controller and determines the voltage reduction in case of spark-over and the value of the so called "finger voltages". Further, the block has an input for total blocking of the DC-supply. To keep the discharge amount of the precipitator constant, the VCO of block 2 is controlled by a voltage from a corona discharge current control block 4 wherein the measured value of the discharge current is compared with a set value for this current.

However, in a precipitator energized with pulses superimposed on the DC-voltage a spark-over does not necessarily mean that the DC-voltage is too high. Therefore, according to a known method described in corresponding United States application, Ser. No. 331,012, filed Dec. 15, 1981 and now U.S. Pat. No. 4,445,911, the pulses are at intervals turned off and the DC-voltage is momentarily raised establishing a so-called "finger voltage". If the DC-voltage is so close to the corona voltage that the finger voltage starts a corona discharge it is taken as an indication that the DC-voltage is too high and should be lowered. A reference circuit for setting the height of the finger is part of the DC-voltage control (block 3) and the height of the finger may be increased by an input signal received on the increased finger voltage input of the block.

An input signal on another input may reduce the continuously increasing DC-voltage the same way as in block 1 and an input signal on still another input may block the DC-supply totally.

The pulses are provided through a SCR-switch being closed. This SCR is controlled from block 2 comprising a voltage controlled oscillator VCO (voltage controlled oscillator) producing trigger pulses. As the corona current shows to be proportional to the pulse frequency it may be controlled by controlling the oscillator frequency. Over a shunt in the ground connection of the HV-rectifier of the DC-supply for the precipitator a voltage signal representative of the corona discharge current is taken out. This signal is in block 4 compared with a set signal representing the wanted discharge current. When the actual discharge current is higher than the set current a differential voltage signal of one polarity is sent to the voltage controlled trigger oscillator in block 2, causing the pulse repetition frequency (PRF) to be lowered. If in opposition hereto the actual discharge current is lower than the set current a signal with the opposite polarity is sent to the VCO causing the repetition frequency to be raised. Such a control system is well known to those skilled in the pertinent art.

In an electrostatic precipitator with only one controllable running parameter, i.e. the high voltage, a spark-over may unambiguously be taken as an indication that the voltage should be lowered. In a precipitator energized with high voltage pulses superimposed on a high DC-voltage it must be decided which of the running parameters should be regulated.

According to our invention this decision is made on the basis of a knowledge of the time of occurrence and the duration of a spark-over. For that purpose spark-overs are sorted in four categories resulting from the possible combinations of the answers of the questions: "Does the spark-over occur during a pulse or between two pulses?" and "Is the spark-over of a duration shorter or longer than a set time?"

The sorting may easily be performed on the basis of only three pieces of information: the precipitator voltage, the starting time of a pulse, and the duration of a pulse.

The sorting of the spark-overs could be performed by a microprocessor which could on basis of the sorting delegate signals to the relevant ones of the blocks 1–4.

Figure 5:
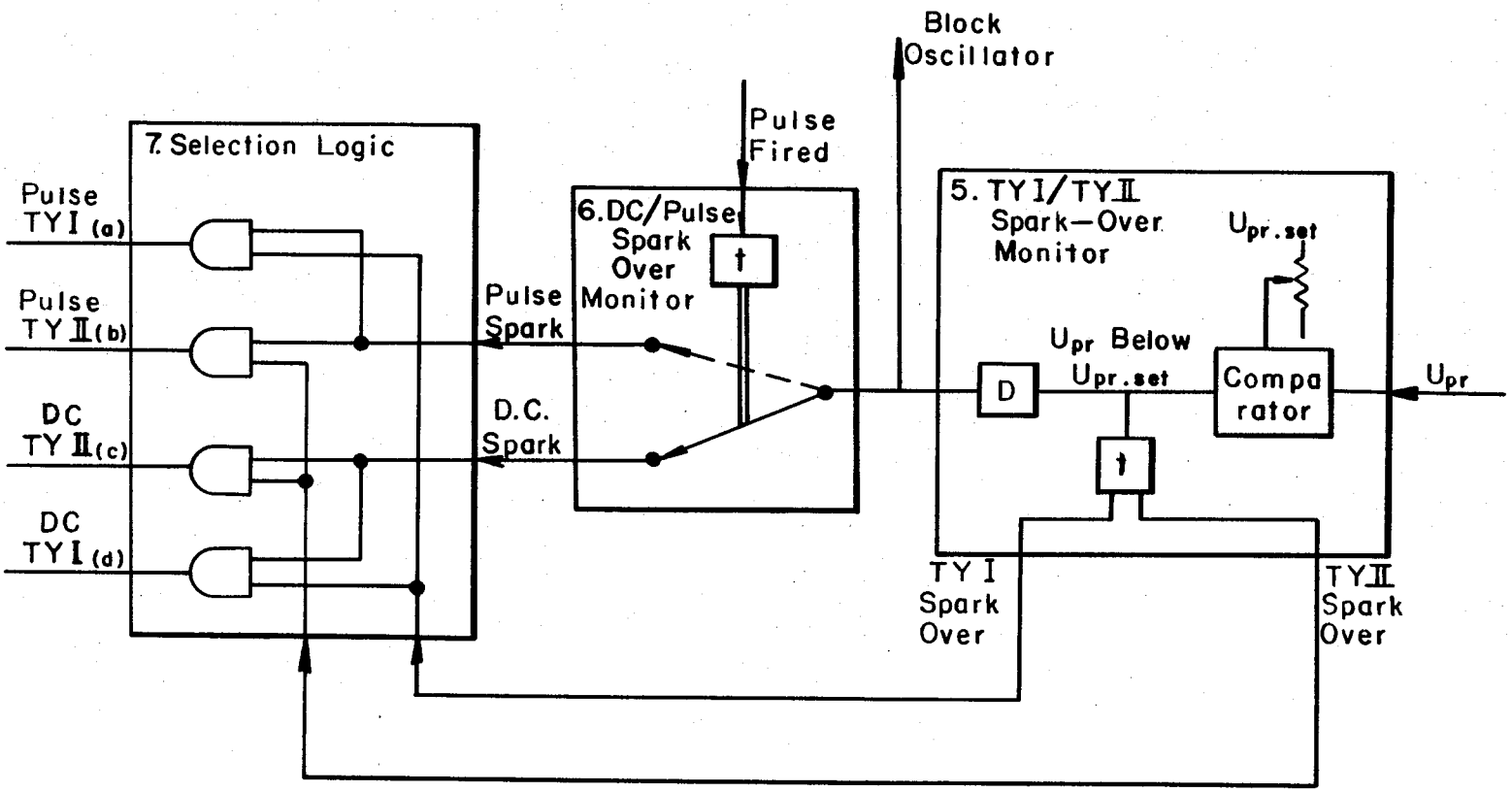
FIG. 5 illustrates in block diagram form and in further detail a portion of FIG. 4.

The sorting may also be performed through hardware as indicated by the blocks 5–7, which is explained below in further details referring to FIG. 5.

A block 5 basically consisting of a comparator, a timer and control logic has an input for the precipitator voltage. The comparator determines when the precipitator voltage is below a set value $U_{set}$, and the timer decides the duration of this situation. According to the duration of the sparking condition indicated by the voltage drop the spark-overs are categorized as type I or type II, and an output signal is given on one of two outputs representing the two types of spark-overs. Further, an output signal indicating that a spark-over occurs is led to block 2 where it blocks the VCO, and to a block 6 which receives a signal from block 2 whenever a pulse is fired. This makes it possible to decide whether a spark-over occurs during a pulse or between two pulses and the block 6 gives an output signal on a corresponding output terminal.

The block 5 output terminals indicating the type of spark-over and the block 6 output terminals are connected to a block 7 which through logic combinations of the signals received sorts the spark-overs in four categories each represented by an output terminal, namely (a) Ty I pulse spark-over.
(b) Ty II pulse spark-over.
(c) Ty II DC spark-over.
(d) Ty I DC spark-over.

Signals on the respective output terminals from block 7 cause different precautions.

A signal on output terminal a causes a reduction of the pulse height.

A signal on output terminal b causes a reduction of the pulse height, but also a blocking of the DC-supply to the precipitator.

A signal on output terminal c also blocks the DC supply and at the same time causes one or more other precautions to be taken. This free choice is represented by the block 8. The precaution can consist of a reduction of the pulse repetition frequency or a reduction of the set value for the filter current $I_E$ which will also result in a reduction of the pulse repetition frequency. The DC-voltage may be reduced either directly or through an increase of the finger voltager, where a "finger" is used for determining where the DC-voltage is placed in relation to the corona onset voltage. The influence of the DC-voltage is exercised through the DC voltage control block 3.

A signal on output terminal d may be neglected or may lead to a choice of the kind represented by block 8.

In operation, a signal representative of the precipitator voltage ($U_{PR}$) is led to the block 5. In this block it is in a comparator compared with a set value. When the precipitator voltage falls below this set value the comparator gives off a signal indicating that a spark-over takes place. This signal starts a timer t, which is reset when the signal ceases. If the timer runs for a set time a signal is given off on an output (Ty II) indicating that the spark-over is of the type II, i.e. of long duration. If the timer is reset before the set time has passed a signal is given off on another output (Ty I) indicating that the spark-over was of the type I, i.e. of short duration. The signal from the comparator is further fed to an output from the block 5 to indicate that a spark-over is taking place. This signal, which through a delay unit D may be delayed to make it last for some time after the precipitator voltage has again risen above the set value, is used for blocking the trigger oscillator (VCO) for the pulse switch, as the pulses should be turned off whenever a spark-over occurs. The signal is fed through a DC/Pulse spark-over monitor (block 6) to a PULSE SPARK output, if the spark-over occurs during a pulse, or to a DC-SPARK output, if the spark-over occurs between two pulses.

This is obtained by the block 6 comprising a switch normally connecting the input to the DC-SPARK output. However, every time a signal from the trigger oscillator (VCO) in block 2 indicates that a pulse is fired a timer in the block 6 is started which timer switches over the connection normally connecting the input of the block to the DC-SPARK output, to connect instead the input with the PULSE SPARK output for the duration of one pulse.

In block 7 (Selection Logic) the outputs from block 6 are through AND-gates (circuits performing logic AND function) combined with the Ty I and Ty II outputs from block 5 to produce outputs representing the four possible combinations, corresponding to four categories of spark-overs.

As an output signal will not occur on the output Ty I of the block 5 until the signal indicating the $U_{PR}$ is below $U_{PR,set}$ has ceased it is necesary to delay the latter signal to make it possible to combine this signal with the Ty output signal.

An output signal on one of the four outputs of block 7 is led to one or more of the control blocks 1–4 to influence the control of the running parameters of the precipitator in a way which lessens the probability of occurrence of a spark-over of the category concerned.

As seen in FIG. 4 a spark-over during a pulse will cause a pulse output signal on the output a or b of block 7 and will therefore always through an OR-gate (circuits performing a logic function) release a reduction of the pulse voltage.

Likewise, a spark-over of long duration, a type II spark-over, causing an output signal on the output b or c of block 7 will always block the DC-voltage as the outputs b and c are connected to the inputs of an OR-gate whose output gives off a DC-voltage blocking signal to the DC-voltage control in block 3 if only one of its inputs receives a signal.

The output c of the block 7 is connected to the one input of an OR-gate the other input of which optionally may be connected to the output d of the block 7. An output signal from this OR-gate is led to a selection logic block 8 which is a simple cross field transferring the signal to one or more of the outputs A–D.

Each of the outputs A–D of block 8 is connected to one of the controls of the power supply of the precipitator. Thus a signal on output B will influence the VCO of block 2, which produces trigger signals for the pulse SCR in a way which reduces the trigger frequency. This reduction may also be obtained by reducing the set value for the precipitator current in block 4 through a signal on output C of block 8.

An output signal on the output D of block 8 may result in an increase of the finger voltage in the DC-voltage control (block 3) if a finger regulation method is employed. Thereby a reduction of the DC-voltage may indirectly be obtained.

A direct reduction of the DC-voltage may be obtained through an output signal on output A of block 8, which signal is not shown, that may be led directly to the input of the DC-voltage control causing a momentary reduction of the constantly increasing DC-voltage, or as shown in FIG. 4 may be connected to said input of block 3 through a spark rate detector 9 so that a signal is only sent to said input if the rate of output signals on output A exceeds a set rate.

I claim:

1. A method of controlling the operating parameters of an electrostatic precipitator having electrodes energized by voltage pulses superimposed upon a DC-voltage which provide a precipitator-voltage over time which comprises:

continuously increasing the height of said pulses according to a predetermined rate;

determining reductions in the precipitator-voltage below a preselected value in order to determine spark-over thereof;

categorizing said spark-over according to the time of its occurrence and duration; and adjusting the operating parameters of the electrostatic precipitator in dependence upon the characteristics of said spark-over.

2. The method according to claim 1 wherein said spark-over is categorized according to the following types:

(a) during a pulse and causing voltage drop of short duration, (b) during a pulse and causing voltage drop of long duration, (c) between pulses and causing voltage drop of long duration, or (d) between pulses and causing voltage drop of short duration.

3. The method according to claim 1 wherein said spark-over when categorized as occurring during a pulse and causing voltage drop of short duration causes the pulse height to be reduced by a predetermined amount.

4. The method according to claim 1 wherein said spark-over when categorized as occurring during a pulse and causing voltage drop of long duration causes the pulse height to be reduced and the DC voltage to be cut off for a predetermined time period.

5. The method according to claim 1 wherein said spark-over when categorized as occurring between pulses and causing voltage drop of long duration necessitates taking one or more of the following precautions:

(A) reducing the DC-voltage by a predetermined amount if the spark-over rate as determined by the time of occurrence and duration of said spark-over is over a pre-selected set value, and subsequently raising it;

(B) reducing pulse repetition frequency by a certain pre-selected amount and subsequently raising it;

(C) reducing a pre-selected set value for precipitator corona discharge current by a certain predetermined amount and subsequently raising it; and (D) increasing a finger voltage in a DC-voltage controller using a periodically occurring finger of increased voltage.

6. The method according to claim 1 wherein said spark-over when categoprized as occurring between pulses and causing voltage drop of short duration necessitates taking one or more of the following precautions:

(A) reducing the DC-voltage by a predetermined amount if the spark-over rate as determined by the time of occurrence and duration of said spark-over is over a pre-selected set value, and subsequently raising it;

(B) reducing pulse repetition frequency by a certain pre-selected amount and subsequently raising it;

(C) reducing a pre-selected set value for precipitator corona discharge current by a certain predetermined amount and subsequently raising it; and (D) increasing a finger voltage in a DC-voltage controller using a periodically occurring finger of increased voltage.

7. The method of claim 1 wherein only the superimposed pulse voltage is turned off in response to said spark-over when categorized as occurring between pulses and causing voltage drop of short duration.

8. The method according to claim 1, wherein said spark-over causes the superimposed pulse voltage to be turned off for a period beyond the time in which the precipitator voltage is below the preselected value.

9. The method according to claim 8 wherein said spark-over when categorized as occurring during a pulse and causing voltage drop of short duration causes the pulse height to be reduced by a predetermined amount.

10. The method according to claim 8 wherein said spark-over when categorized as occurring during a pulse and causing voltage drop of long duration causes the pulse height to be reduced and the DC voltage to be cut off for a predetermined time period.

11. The method according to claim 8 wherein said spark-over when categorized as occurring between pulses and causing voltage drop of long duration necessitates taking one or more of the following precautions:

(A) reducing the DC-voltage by a predetermined amount if the spark-over rate as determined by the time of occurrence and duration of said spark-over is over a pre-selected set value, and subsequently raising it;

(B) reducing pulse repetition frequency by a certain pre-selected amount and subsequently raising it;

(C) reducing a pre-selected set value for precipitator corona discharge current by a certain predetermined amount and subsequently raising it; and (D) increasing a finger voltage in a DC-voltage controller using a periodically occurring finger of increased voltage.

12. The method according to claim 8 wherein said spark-over when categorized as occurring between pulses and causing voltage drop of short duration necessitates taking one or more of the following precautions:

(A) reducing the DC-voltage by a predetermined amount if the spark-over rate as determined by the time of occurrence and duration of said spark-over is over a pre-selected set value, and subsequently raising it;

(B) reducing pulse repetition frequency by a certain pre-selected amount and subsequently raising it;

(C) reducing a pre-selected set value for precipitator corona discharge current by a certain predetermined amount and subsequently raising it; and (D) increasing a finger voltage in a DC-voltage controller using a periodically occurring finger of increased voltage.

13. A method of controlling the operating parameters of an electrostatic precipitator energized by voltage pulses superimposed on a DC-voltage which provide a precipitator voltage over time, characterized in that the pulse height is continuously increased with a preselected slope; a spark-over is detected as a reduction in the precipitator-voltage below a selectable set value and is sorted as to its type according to the time of its occurrence and its duration, and the operating parameters of the precipitator are altered, depending upon the type of said spark-over.

14. The method according to claim 13 wherein said spark-over when sorted as occurring during a pulse and causing voltage drop of short duration causes the pulses height to be reduced by a predetermined amount.

15. The method according to claim 13 wherein said spark-over when sorted as occurring during a pulse and causing voltage drop of long duration causes the pulse height to be reduced and the DC voltage to be cut off for a predetermined time period.

16. The method according to claim 13 wherein said spark-over when sorted as occurring between pulses and causing voltage drop of long duration necessitates taking one or more of the following precautions:

(A) reducing the DC-voltage by a predetermined amount if the spark-over rate as determined by the time of occurrence and duration of said spark-over is over a pre-selected set value, and subsequently raising it;

(B) reducing pulse repetition frequency by a certain pre-selected amount and subsequently raising it;

(C) reducing a pre-selected set value for precipitator corona discharge current by a certain predetermined amount and subsequently raising it; and (D) increasing a finger voltage in a DC-voltage controller using a periodically occurring finger of increased voltage.

17. The method according to claim 13 wherein said spark-over when sorted as occurring between pulses and causing voltage drop of short duration necessitates taking one or more of the following precautions:

(A) reducing the DC-voltage by a predetermined amount if the spark-over rate as determined by the time of occurrence and duration of said spark-over is over a pre-selected set value, and subsequently raising it;

(B) reducing pulse repetition frequency by a certain pre-selected amount and subsequently raising it;

(C) reducing a pre-selected set value for precipitator corona discharge current by a certain predetermined amount and subsequently raising it; and (D) increasing a finger voltage in a DC-voltage controller using a periodically occurring finger of increased voltage.

18. The method according to claim 13, wherein said spark-over is sorted according to the following types:

(a) during a pulse and causing voltage drop of short duration;

(b) during a pulse and causing voltage drop of long duration;

(c) between pulses and causing voltage drop of long duration; and (d) between pulses and causing voltage drop of short duration.

* * * * *